US007909043B2

(12) United States Patent
Kurek et al.

(10) Patent No.: US 7,909,043 B2
(45) Date of Patent: Mar. 22, 2011

(54) BRUSH FOR APPLYING A COSMETIC PRODUCT

(75) Inventors: John S. Kurek, Goshen, NY (US); David Cerutti, Putnam Valley, NY (US)

(73) Assignee: Avon Products, Inc., New York, NY (US)

( * ) Notice: Subject to any disclaimer, the term of this patent is extended or adjusted under 35 U.S.C. 154(b) by 1306 days.

(21) Appl. No.: 11/124,484

(22) Filed: May 6, 2005

(65) Prior Publication Data

US 2006/0249171 A1 Nov. 9, 2006

(51) Int. Cl.
*A45D 40/26* (2006.01)
*A46B 9/08* (2006.01)
*A46B 3/18* (2006.01)

(52) U.S. Cl. ..... 132/218; 15/168; 15/206

(58) Field of Classification Search ..... 132/218, 132/237, 320, 313, 270; 401/129, 14, 193; 15/206, 168, 169; D4/128, 131, 109, 127; D28/37, 7
See application file for complete search history.

(56) References Cited

U.S. PATENT DOCUMENTS

| | | | | | |
|---|---|---|---|---|---|
| 3,381,693 | A * | 5/1968 | Stevens | 132/123 |
| 4,167,192 | A * | 9/1979 | Arnold | 132/212 |
| 4,428,388 | A | 1/1984 | Cassai et al. | |
| 4,662,385 | A * | 5/1987 | Schefer | 132/218 |
| 4,744,377 | A | 5/1988 | Dolan, Jr. | |
| 5,027,838 | A | 7/1991 | Iaia et al. | |
| 5,799,669 | A * | 9/1998 | Briggs | 132/208 |
| 5,887,600 | A * | 3/1999 | Wilk | 132/262 |
| 5,911,226 | A * | 6/1999 | Vecchiola et al. | 132/211 |
| 6,070,597 | A * | 6/2000 | Motherhead | 132/262 |
| 6,295,994 | B1 | 10/2001 | Thayer et al. | |
| 6,634,051 | B1 * | 10/2003 | Dragan et al. | 15/106 |
| 6,647,582 | B1 * | 11/2003 | Rechelbacher | 15/143.1 |
| 6,915,543 | B2 * | 7/2005 | McEntyre et al. | 15/160 |
| 2004/0226573 | A1 * | 11/2004 | Gueret | 132/218 |
| 2006/0042648 | A1 * | 3/2006 | Teller | 132/237 |

FOREIGN PATENT DOCUMENTS

DE 32 29 786 A1 * 10/1982

* cited by examiner

*Primary Examiner* — Cris L Rodriguez
*Assistant Examiner* — Rachel R Steitz
(74) *Attorney, Agent, or Firm* — Charles J Zeller; Joan M. McGillycuddy; Anthony M. Santini

(57) ABSTRACT

A bristle brush for applying a cosmetic product to hair is provided with a sleeve having a longitudinal axis and at least one perforation. The brush is disposed within the sleeve so that brush bristles extend through the perforation for contact with the hair. The perforation is circular, arcuate, rectangular, square, triangular or trapezoidal in shape or at an angle with respect to the longitudinal axis of the sleeve. When the sleeve has a plurality of perforations, the perforations can be shaped alike or can differ in shape and/or in angle with respect to the longitudinal axis of the sleeve so that one or more predetermined performance characteristics are obtained when the brush is used to apply the cosmetic product to the hair. A method for adjusting brush performance characteristics is also disclosed.

13 Claims, 6 Drawing Sheets

BRUSH FOR APPLYING A COSMETIC PRODUCT

FIELD OF THE INVENTION

The present invention relates to a brush for applying a cosmetic and in particular a mascara. The brush is provided with a perforated sleeve over the brush which disrupts the configuration of the brush bristles. The perforations in the sleeve also act as a reservoir for the cosmetic product and in particular for the mascara. The device of the present invention can be employed with a conventional rod and vial configuration.

Advantageously, by varying the number of perforations the shape, and/or angle or orientation of the perforations with respect to the longitudinal axis of the sleeve, one can obtain one or more predetermined desired performance characteristics of the brush.

BACKGROUND OF THE INVENTION

U.S. Pat. No. 6,295,994 discloses a mascara applicator comprising a conventional twisted wire core with a plurality of radially extending bristles regularly disposed in a first orientation. A cylindrically configured helix is twisted onto the brush around the wire core so that the brush bristles extend radially between successive loops of the helix. The helix moves at least some of the bristles to a second orientation so as to alter one or more brush characteristics such as mascara retention, mascara application, combing characteristics and brush appearance. The dimensions of the helix, pitch of the helix and thickness of the helix body are preselected to yield the desired characteristics in the finished brush.

U.S. Pat. No. 5,027,838 discloses a cosmetic applicator having a brush with radially adjustable length bristles. The applicator includes a brush head, shaft and sleeve. The brush head has an elongated brush stem with a plurality of bristles circumferentially attached tufts radiating outwardly therefrom. A plurality of perforations are provided in an end of the sleeve through which the bristle tufts are forced to protrude. The brush head and shaft to which the latter is attached are held within the sleeve. When the sleeve is rotated, the bristle tufts protruding through the perforations will wind or unwind around the brush stem, depending on the direction of rotation. In such manner, the effective outward radial length of the protruding bristles tufts can be adjusted.

SUMMARY OF THE INVENTION

In the sleeve-brush construction of the present invention, a bristle brush of any construction is inserted into a sleeve of oval, round, square, hexagonal or triangular cross-section. The sleeve is perforated to allow the brush bristle fibers to protrude therethrough. The number of bristles fibers protruding per perforation may be controlled by adjustment of the relative size of the perforations. The number of perforations in the sleeve may also be varied to obtain a final brush of the desired overall bristle count.

The perforations in the sleeve may be discontinuous, parallel, perpendicular, or any angle in between relative to the longitudinal axis of the applicator. The perforations may also intersect each other so as to form crosses V's and/or L's. The perforations may be formed into shapes, curves, or curve patterns in any repetitive or non-repetitive arrangement. For example, the perforations may form a company logo. Perforations may be positioned near each other or far from one another in order to adjust the performance of the brush.

BRIEF DESCRIPTION OF THE DRAWINGS

The present invention will now be described with reference to the accompanying drawings in which.

DETAILED DESCRIPTION OF THE INVENTION

Figure 1:
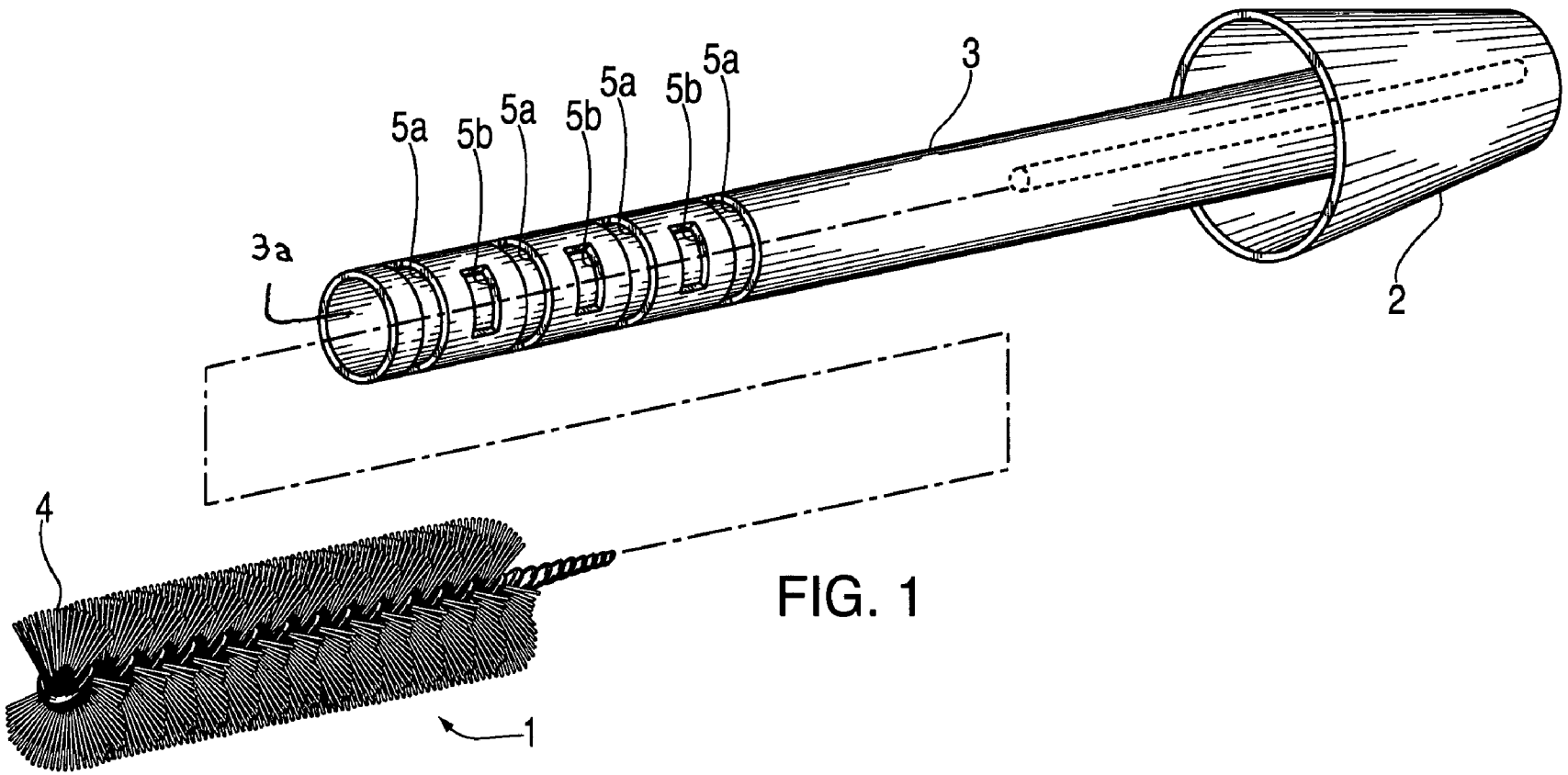
FIG. 1 is an exploded perspective view of an embodiment of a brush assembly in accordance with the present invention.

As shown in FIG. 1, the brush assembly of the present invention is comprised of a twisted wire brush 1 having a handle 2. Such brushes are well known to those skilled in the art. They are generally produced by placing a layer of fibers between the legs of a U-shaped pin then fixing one end of the pin while twisting the other end to form a helix. The fibers are entrapped within the turns of the helix, such fibers being hereinafter generally referred to as bristles 4. Brush 1 is encased within sleeve 3. In the embodiment of FIG. 1, sleeve 3 is provided with rectangular perforations 5*a* and 5*b* which differ in length.

Figure 2:
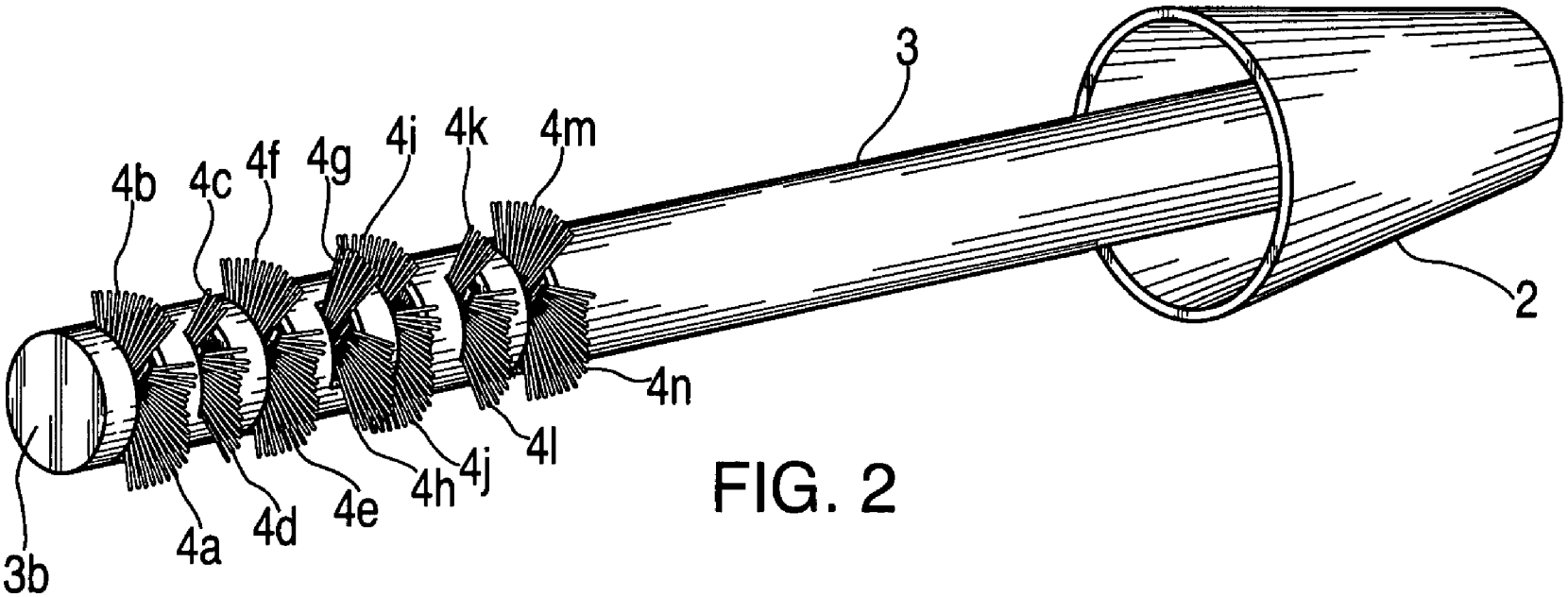
FIG. 2 is a perspective view of the embodiment of FIG. 1 with the brush in place and the end of the assembly capped.

As shown in FIG. 2, when brush 1 is positioned within the bore of sleeve 3, a portion of the bristles of the brush that underlie the perforations will protrude through the perforations (brush portions 4*a*-4*n*). Any bristles protruding through the end 3*a* of sleeve 3 can be trimmed or, as shown in brush portions FIG. 2, end 3*a* can optionally be closed by cap 3*b*, or any other suitable closure. Instead of cap 3*b* one can permit the tufts of the enclosed brush to protrude through end 3*a* or utilize as a closure another functional element such as a comb or like styling implement. Once positioned within the sleeve 3, and the brush 1 and hence the brush portions 4*a*-4*n* are fixed into position, and the brush 1 does not rotate relative to the sleeve 3.

Figure 3:
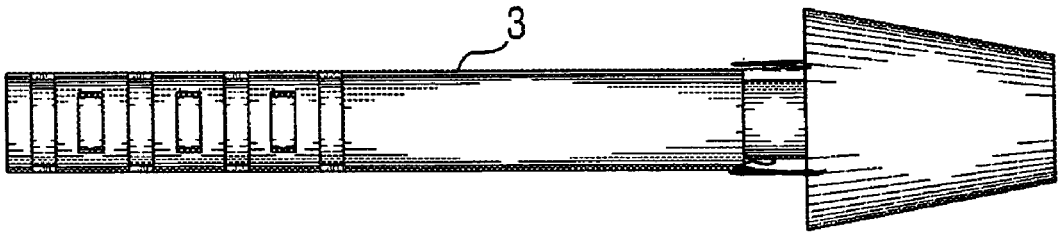
FIG. 3 is a perspective view of an embodiment wherein the sleeve has rectangular perforations that differ in length.
Figure 4:
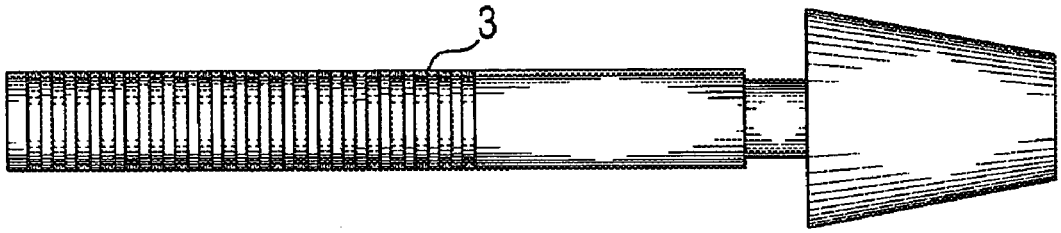
FIGS. 4-6 are perspective views of embodiments wherein the sleeve has rectangular perforations that differ in width, spacing between perforations and number of perforations.
Figure 5:
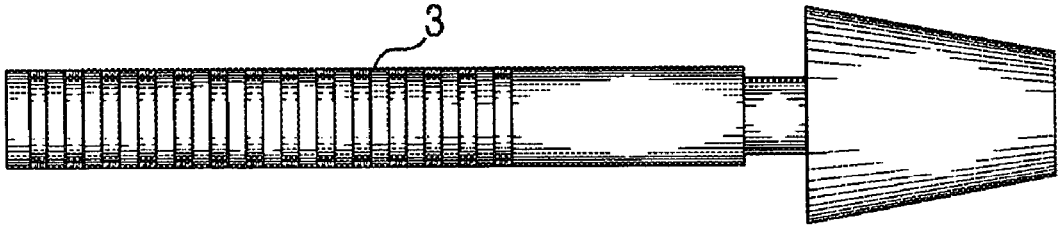
Figure 6:
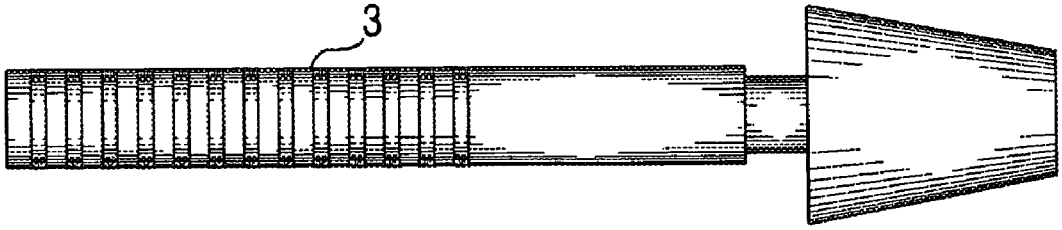

As is illustrated in the embodiments of FIGS. 3-6, the perforations in sleeve 3 can be rectangular in shape and can vary in number, spacing, width and length. They can be uniform in width, length and spacing as shown in FIGS. 4, 5 and 6 or vary, as shown in FIG. 3.

Figure 7:
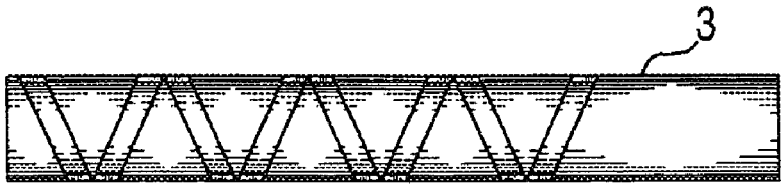
FIGS. 7, 8 and 10 are perspective views of embodiments wherein the sleeve has rectangular perforations that are angularly offset with respect to the longitudinal axis of the sleeve.
Figure 8:
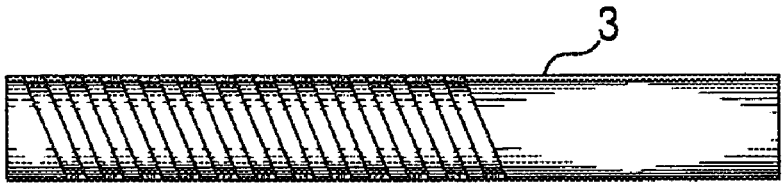
Figure 10:
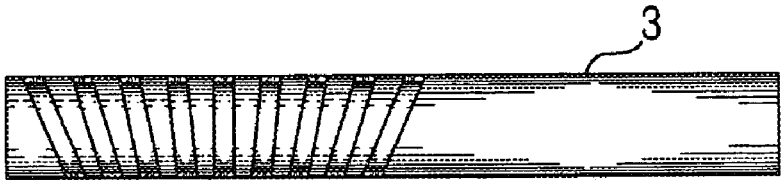
Figure 11A:
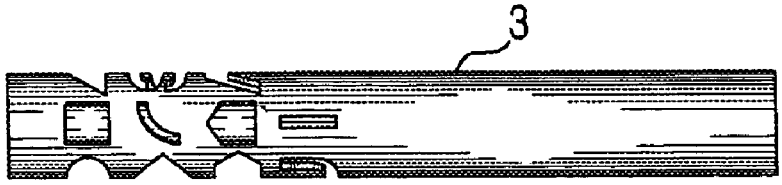
FIGS. 11*a-f* are perspective views of embodiments illustrating examples of various geometric shaped perforations that can be employed.
Figure 11B:
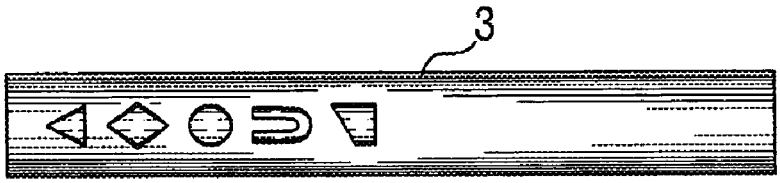
Figure 11C:
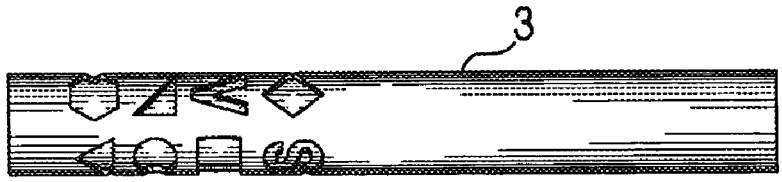
Figure 11D:
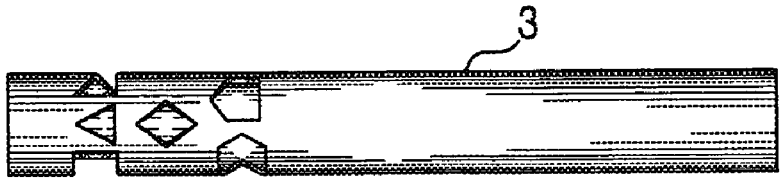
Figure 11E:
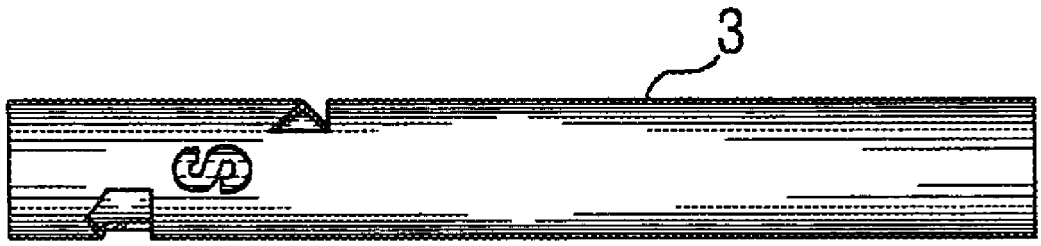
Figure 11F:
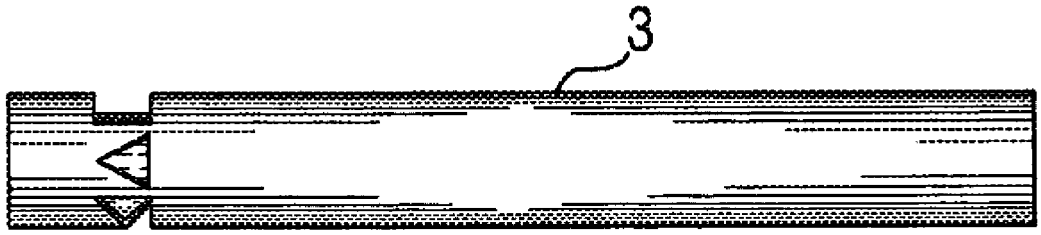

As is illustrated in the embodiments of FIGS. 7, 8 and 10, the perforations on sleeve 3 can be angularly offset with respect to the longitudinal axis of sleeve 3. In FIG. 7 one perforation is at an acute angle with respect to the adjacent perforation.

Figure 9:
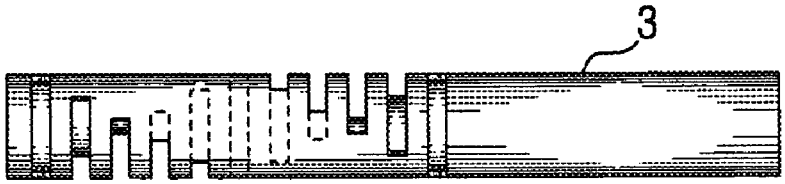
FIG. 9 is a perspective view of an embodiment wherein the sleeve perforations are stepped to form a helix-like pattern around the circumference of the sleeve.

As shown in FIG. 9, the perforations can be stepped so that a helix-like pattern is formed around the circumference of sleeve 3.

In FIG. 10 the rectangular perforations in sleeve 3 fan out.

As is illustrated in the embodiments of FIGS. 11*a-f*, the perforations on sleeve 3 can be of virtually any suitable geometric shape, for example, square, diamond, pentagon, hexagon, circle, semi-circle, triangle, arc, rectangle, polygon. The perforation can also be shaped in the form of a letter, for example, an S, T, U, V or W or in the form of a plus sign. The perforations can vary in length and width. A perforation can even be tapered or pie shaped. The number of perforations and types of perforations employed on a sleeve can be varied. By selecting a particular shaped perforation or combination of shaped perforations, and a particular configuration of the perforations on sleeve 3, one can obtain a brush having one or more predetermined performance characteristics.

Typically, the plurality of perforations are provided sequentially on the surface of the sleeve 3 and along its longitudinal axis, although the perforations do not have to be in longitudinal alignment. Accordingly, the perforations may be randomly placed along the length of the cylindrical surface of the sleeve and may also be located anywhere in the lateral axis of the sleeve. Preferably, all of the perforations are situated wholly within the cylindrical surface of the sleeve 3. Also preferably, the perforations, when rectangular in geometry, have a major side where their length is not substantially collinear with the longitudinal axis of the sleeve. By substantially collinear is meant that the major side of the perforation forms with the longitudinal axis an angle of less than about 15°, preferably less than about 30°.

Traditionally, brush construction allows for the following variables:

(1) fibers per turn
(2) cut length of fibers
(3) diameter of fibers
(4) length of brush
(5) fiber material and
(6) fiber cross-section.

Typically, the performance of a particular brush can only be defined by adjusting these variables.

The perforated sleeve-brush assembly of the present invention introduces a new design variable that can precisely determine the final characteristic of a brush. All of the aforementioned traditional employed variables may still be applied; however, in accordance with the present invention, one skilled in the art will now be able to further define an applicator by:

(1) fibers per perforation
(2) perforations per inch
and (3) perforation configuration.

Advantageously, the perforations in the sleeve also act as a reservoir for a cosmetic product, such as a mascara. As the brush assembly of the present invention is withdrawn from the product container, the cosmetic product will enter the perforations then, during application, will transfer to the surface to which the product is applied (e.g. the eyelashes, eyebrows or hair).

Typically, mascara containers employ a wiper to remove excess mascara from a mascara brush as it is withdrawn from its container. When a wiper is used with the brush-sleeve assembly of the present invention, it acts to force the mascara into the perforations.

The size and shape of the perforations precisely determine the amount of cosmetic product (for example, mascara) that remains on the applicator after wiping.

Advantageously, due to mechanical support offered by the perforation edges, finer fibers may be employed in the construction of the brush. Finer fibers have a softer feel and allow for improved combing, definition and separation of the hair.

What is claimed is:

1. A brush assembly for applying a cosmetic product to hair in combination with a container initially holding the cosmetic product, the brush comprising:

a sleeve having a longitudinal axis and at least one perforation, and a brush removably insertable into the sleeve, the brush having a plurality of bristles forming brush portions that extend through the at least one perforation wholly within the cylindrical surface of the sleeve;

wherein the at least one perforation acts as a reservoir for the cosmetic product when the brush is withdrawn from the container; and wherein the at least one perforation comprises a major side that is not collinear with the longitudinal axis of the sleeve.

2. The brush assembly as claimed in claim 1, wherein the sleeve has plurality of perforations having a shape selected from the group consisting of circular, arcuate, rectangular, square, triangular, or trapezoidal in shape, or any combination thereof.

3. The brush assembly as claimed in claim 2, wherein the one of the plurality of perforations forms an angle with respect to the longitudinal axis of the sleeve.

4. The brush assembly as claimed in 2, wherein one of the plurality of perforations differs in shape from another perforation.

5. The brush assembly as claimed in claim 2, wherein one of the plurality of perforations is arcuate in shape.

6. The brush assembly as claimed in claim 2, wherein one of the plurality of perforations is rectangular in shape.

7. The brush assembly as claimed in claim 2, wherein one of the plurality of perforations is triangular in shape.

8. The brush assembly as claimed in claim 2, wherein one of the plurality of perforations is trapezoidal in shape.

9. The brush assembly as claimed in claim 2, wherein at least one of said perforations is arcuate in shape and at least one other of said perforations is rectangular, triangular or trapezoidal in shape or is at an angle with respect to the longitudinal axis of the sleeve.

10. The brush assembly as claimed in claim 2, wherein at least one of said perforations is rectangular in shape and at least one other of said perforations is triangular or trapezoidal in shape or is at an angle with respect to the longitudinal axis of the sleeve.

11. The brush assembly as claimed in claim 2, wherein at least one of said perforations is trapezoidal in shape and at least one other of said perforations is rectangular or triangular in shape or is at an angle with respect to the longitudinal axis of the sleeve.

12. The brush assembly as claimed in claim 2, wherein at least one of said perforations is at a first angle with respect to the longitudinal axis of the sleeve and at least one other of said perforations is at a second angle with respect to the longitudinal axis of the sleeve, the first and second angles differing from one another.

13. A method for adjusting performance characteristics of a brush assembly for applying a cosmetic product to hair, the brush assembly being in combination with a container initially holding the cosmetic product, said brush having bristles, a sleeve having a longitudinal axis and at least one perforation, the brush removably insertable into the sleeve so that at least a portion of the bristles extend through the at least one perforation for contact with the hair, wherein the at least one perforation acts as a reservoir for the cosmetic product when the brush is withdrawn from the container, and wherein the at least one perforation comprises a major side that is not collinear with the longitudinal axis of the sleeve;

the method comprising adjusting one or more of the following parameters (i) length of the at least one perforation; (ii) width of the at least one perforation; (iii) bristle thickness; (iv) bristle length; (v) angle of the at least one perforation with respect to the longitudinal axis of the sleeve; (vi) shape of the at least one perforation; and (vii) the position of the at least one perforation with respect to another perforation, whereby one or more predetermined performance characteristics of the brush are obtained when it is employed to apply the cosmetic product to the hair.

* * * * *